US010206489B2

(12) United States Patent
Samaripa

(10) Patent No.: US 10,206,489 B2
(45) Date of Patent: Feb. 19, 2019

(54) MULTI-FUNCTIONAL UTILITY MAT

(71) Applicant: Jeff Samaripa, Yorba Linda, CA (US)

(72) Inventor: Jeff Samaripa, Yorba Linda, CA (US)

( * ) Notice: Subject to any disclaimer, the term of this patent is extended or adjusted under 35 U.S.C. 154(b) by 216 days.

(21) Appl. No.: 15/163,601

(22) Filed: May 24, 2016

(65) Prior Publication Data

US 2016/0374460 A1 Dec. 29, 2016

Related U.S. Application Data

(63) Continuation of application No. 14/020,699, filed on Sep. 6, 2013, now Pat. No. 9,428,931.

(51) Int. Cl.

| | |
|---|---|
| ***A45F 4/04*** | (2006.01) |
| ***A45F 4/02*** | (2006.01) |
| ***A45F 4/06*** | (2006.01) |
| ***A47G 9/06*** | (2006.01) |
| ***E04H 15/30*** | (2006.01) |
| *E04H 15/00* | (2006.01) |
| *A45F 3/04* | (2006.01) |
| *E04H 15/60* | (2006.01) |

(52) U.S. Cl.

CPC ..... *A45F 4/02* (2013.01); *A45F 4/04* (2013.01); *A45F 4/06* (2013.01); *A47G 9/062* (2013.01); *E04H 15/30* (2013.01); *A45F 3/04* (2013.01); *E04H 15/00* (2013.01); *E04H 15/60* (2013.01)

(58) Field of Classification Search

CPC .... A45F 4/04; A45F 4/06; A47G 9/06; A47G 9/062

See application file for complete search history.

(56) References Cited

U.S. PATENT DOCUMENTS

| | | | | |
|---|---|---|---|---|
| 1,089,103 A * | 3/1914 | Barnard | E04H 15/30 135/115 |
| 4,991,978 A * | 2/1991 | Ostrowski | A45C 3/10 383/13 |
| 5,187,823 A * | 2/1993 | Ferguson | A45C 9/00 190/1 |
| 5,482,374 A * | 1/1996 | Buhyoff | A45B 23/00 383/4 |
| 5,819,343 A * | 10/1998 | Zampirri, Jr. et al. | |
| 5,899,571 A | 5/1999 | Chalk | |
| D714,078 S * | 9/2014 | Russo, Jr. | A47G 9/062 D6/608 |

(Continued)

*Primary Examiner* — David R Dunn
*Assistant Examiner* — Danielle Jackson
(74) *Attorney, Agent, or Firm* — Michael N. Cohen; Cohen IP Law Group PC

(57) ABSTRACT

A multi-purpose mat comprises a circular flat body portion having an inner surface and an outer surface. The inner surface comprises a structural fold pattern. The outer surface comprises a plurality of wing pockets extending from a peripheral edge and spaced at ninety degree intervals that may be folded into a plurality of interior pockets between the outer surface and the inner surface, a drawstring interwoven through a plurality of eyelets along the perimeter, a pair of webbing straps positioned at right angles to each other, and a pair of pole pockets below the pair of webbing straps, a bag clip and a bag handle. A functional strap and a plurality of tent poles allow the multi-purpose mat to be configured into a beach mat, a backpack bag, a surfboard carrier sling and a shade shelter.

18 Claims, 8 Drawing Sheets

(56) References Cited

U.S. PATENT DOCUMENTS

| | | | | |
|---|---|---|---|---|
| 8,950,643 | B2 * | 2/2015 | Shen | A45F 4/02 224/578 |
| 9,428,931 | B2 * | 8/2016 | Samaripa | E04H 15/30 |
| 9,578,952 | B1 * | 2/2017 | Wray | A45F 3/04 |
| 2005/0005355 | A1 * | 1/2005 | Marks | A47G 9/062 5/417 |
| 2005/0051203 | A1 * | 3/2005 | McCully | A45F 4/00 135/87 |
| 2007/0127849 | A1 * | 6/2007 | Lakis | A45F 4/02 383/4 |
| 2014/0252052 | A1 * | 9/2014 | Shlafer | A47G 9/062 224/153 |

* cited by examiner

MULTI-FUNCTIONAL UTILITY MAT

CROSS-REFERENCE TO RELATED APPLICATIONS

This application is a continuation of U.S. patent application Ser. No. 14/020,699, filed Sep. 6, 2013.

STATEMENT REGARDING FEDERALLY SPONSORED RESEARCH AND DEVELOPMENT

Not Applicable.

FIELD OF THE DISCLOSURE

This embodiment relates to multi-purpose mats, and more particularly to a multi-purpose mat that may be converted into a beach mat, a backpack bag, a surfboard carrier sling and a shade shelter.

DISCUSSION OF RELATED ART

Traditional beach mats are rectangular in shape and must be picked up and rotated by a sunbather to adjust to the movement of the sun. They are typically too narrow to accommodate people and accessories, beach bags, etc. Traditional mats are light and often blow around or even blow away in shore winds. When it is time to clean up, wetsuit and other beach accessories may be wrapped up in the mat and carried to the car. However, traditional mats are not able to fully and securely close for transport and storage, leaving open the possibility that things may fall out and be lost during storage or transport. Multi-purpose mats are currently available that convert into storage bags. These mats utilize some form of cloth material having drawstrings or zippers along the perimeter thereof. However, the closure means may not be quickly and effectively operated to convert the multi-purpose mat into a storage bag. Also, they require the user to spend considerable time and effort to convert the device from a storage bag back into a mat, as none of the mats utilize structural members to help perform that function. Furthermore, certain mats do not provide a comfortable padded surface. Additionally, some mats converted into storage bags are cumbersome to transport from location to location. Currently available multi-purpose mats cannot be converted into more than two forms including a surfboard carrier sling and a beach tent.

U.S. Pat. No. 5,899,571 issued to Chalk on May 4, 1999 provides a combination beach towel, tote bag and beach umbrella system including a towel member, an umbrella member and an umbrella support. The towel member has a towel perimeter edge defining a towel shape, a drawstring sleeve provided adjacent to the towel perimeter, and a draw string having a first and second drawstring end positioned through the drawstring sleeve with the first and second drawstring ends extending out from the drawstring sleeve. The umbrella member has an umbrella perimeter defining an umbrella shape corresponding to the towel shape in a manner such that the umbrella perimeter and the towel perimeter can be placed in registration and four elongated, tubular shaped, fabric, pole attachment sleeves open at both ends thereof, each pole attachment sleeve attached to a first side of the umbrella member and extending from the umbrella perimeter radially toward the center of the umbrella member. The umbrella member and the towel members are securable together along their perimeters. The sectional umbrella support includes a two part vertical support pole including an umbrella spike having a diameter sized to pass through the umbrella spike aperture of the towel member, a central support having a first end adapted for connection with the vertical support pole and for horizontal support pole connecting members. However, the umbrella system is made from terry cloth which does not provide protection from rain since it is not waterproof. Further, the umbrella shade system provides less stability in windy conditions. Moreover, the tote bag is incapable of carrying heavy items such as surfboards, beach chairs etc.

Similarly, U.S. Pat. No. 5,482,374 issued to Buhyoff on Jan. 9, 1996 describes a beach towel constructed with a polygonal center panel from which extend separate trapezoidal panels creating a towel with a substantially polygonal perimeter. The panels are sewn together to provide a strong reinforced structure, and a drawstring around the perimeter permits conversion of the towel into a bag-like structure. Cord casings surround the perimeter of the trapezoid panels. The cord casings are preferably made of a smooth fabric such as nylon which permits a draw cord to be easily drawn through cord casing. The openings between cord casings permit the cord to be staked down with stakes. In the preferred embodiment, a number of pockets are provided with Velcro closures. The pockets may be used for storing items such as sunscreens/lotions, keys, wallets, books, etc., or may be stuffed with clothing to make a pillow. A cord lock or cinch mechanism is provided to lock the cord when it is drawn to create a carry bag out of the towel. A carry strap is provided on the backside of the towel for carrying the towel when the cord is cinched to create a bag. The strap may have a zipper or Velcro pocket for storing a wallet, keys, etc. A telescoping pole allows the towel to be used as an umbrella. However, the set up of umbrella is time consuming and difficult. Further, the umbrella does not provide protection from rain. Moreover, the carry bag cannot carry large objects like surfboards and beach chairs.

In addition, U.S. Pat. No. 5,187,823 issued to Ferguson on Feb. 23, 1993 discloses an article which is capable of being configured as a blanket or mat or the like, or as a carrying bag or knapsack. The article is made of a fabric piece having two opposing arcuate fabric channel halves secured to the lower surface thereof, facing each other. The channel halves define a generally circular channel in the center of the fabric piece. Gaps between the opposing ends of the fabric channel halves expose at least one and preferably two separate continuous ropes which pass through the channel. The fabric piece has a generally circular central portion of smaller diameter than the channel, with at least one retaining loop secured near the circumference thereof. A carrying bag may be formed by folding those portions of the fabric piece which are outside the channel upwardly and in towards the center of the fabric piece, thereby exposing the ropes in the gaps, by then pulling the ropes to bunch the fabric channel halves thereon, and by then routing the pulled ropes through at least one retaining loop and tying them to define a carrying loop in the fashion of a shoulder strap. Where two ropes and two retaining loops are provided, a backpack configuration may be produced by securing one rope to each retaining loop, such that one rope goes over one shoulder, and the other rope goes over the other shoulder. Preferably, at least one pocket is provided on the underside of the fabric piece, outside the channels. However, the mat does not have a provision for providing shelter. Further, the carry bag cannot carry heavy and oversized gear such as surfboards, beach chairs and food coolers.

In light of the foregoing, there is a need for a multi-purpose mat that can be converted into a beach mat, a backpack bag, a surfboard carrier sling and a shade shelter. Such a needed multi-purpose mat would be easily configured to achieve the different forms. Such a multi-purpose mat would be circular in shape. The multi-purpose mat would comprise a cushiony waterproof foam surface that does not collect sand, dries quickly, and provides more surface area than a traditional beach towel. The mat would also comprise multiple pockets to stash sunglasses, wallet, cell phone etc. Further, the mat would be able to carry heavy gear such as surfboards, beach chairs, food coolers, and firewood. Such a unique multi-purpose mat would provide shelter from both sun and rain. The present embodiment accomplishes these objectives.

SUMMARY OF THE DISCLOSURE

The present embodiment is a multi-purpose mat for surfers and beach goers. The multi-purpose mat provides a single product which can transform into four different forms including a beach mat, a backpack bag, a surfboard carrier sling and a shade shelter. The multi-purpose mat comprises a circular flat body portion having an inner surface and an outer surface. The inner surface comprises a structural fold pattern that allows the multi-purpose mat to be transformed into the backpack bag. A plurality of wing pockets extends from a peripheral edge of the outer surface and spaced at ninety degree intervals from each other. A plurality of interior pockets is located between the inner surface and the outer surface and adjacent to the plurality of wing pockets. The plurality of wing pockets may be folded into the plurality of interior pockets. A drawstring is interwoven through a plurality of eyelets along the perimeter of the outer surface.

A pair of straps which may be webbed shaped are attached to the outer surface and positioned at right angles to each other. Each of the pair of webbing straps extends between at least two of the plurality of wing pockets on opposite edges of the outer surface and has a pair of grommets at opposing ends. A pair of pole pockets is attached to the outer surface and below the pair of webbing straps. At least one of the plurality of wing pockets includes a bag clip, a bag handle and a pair of clip receivers on both sides of the bag handle. The invention also includes a functional strap and a plurality of tent poles.

The multi-purpose mat provides a beach mat that offers more surface area than a traditional beach towel for sitting, or sunbathing or standing while changing into dry cloths. The inner surface of the mat is made of molded diamond EVA (Ethylene Vinyl Acetate) film cushion or the like which is waterproof. The water proof EVA film cushion provides padding, does not collect sand and dries quickly. The plurality of wing pockets and the plurality of interior pockets provide a means for storing accessories that may be chosen from a group including but not limited to: sunglasses, wallet, cell phone, surf wax and wet suit. The beach mat makes changing into a wetsuit on a rocky beach, dirt trail, or asphalt parking lot clean and comfortable. Further, the beach mat can be cleaned easily by hosing off and hanging to dry.

The multi-purpose mat provides a backpack bag that is capable of expanding to accommodate larger items that do not normally fit in a traditional backpack. The plurality of wing pockets is folded into the plurality of interior pockets, except the at least one of the plurality of wing pockets with the bag clip and the bag handle, which acts as a flap for closing the bag. The mat is transformed along the structural fold pattern into the shape of the backpack bag and the drawstring is drawn tight and tied with a cord lock to keep the backpack bag from unfolding. The pair of webbing straps provides a plurality of attachment points for the bag clip and the functional strap. The wing pocket flap is closed over the top of the bag and the bag clip is secured on at least one of the plurality of attachment points of the pair of webbing straps. The functional strap comprises an adjustable strap with a plurality of clips and a pair of shoulder pads closed over the adjustable strap. The functional strap may be converted into a backpack harness, a messenger bag harness or carry handle by changing the attachment points on the bag.

The multi-purpose mat provides a surfboard carrier sling that provides a versatile way to transport surfboards. The multi-purpose mat is folded in half along one of the pair of webbing straps and a surfboard is inserted in between the two halves of the mat. The mat folds over the surfboard and the wing pocket flap is secures closure by attaching the bag clip to one of plurality of attachment points on the pair of webbing straps, isolating the surf board in the sling. The pair of clips of the functional strap is attached to the pair of clip receivers on both sides of the bag handle. The functional strap provides a comfortable shoulder strap which makes it easy to transport the surfboard to the beach, while the EVA film cushion of the inner surface of the mat protects from dings while in transit. The surfboard carrier sling has an open ended design that adapts to fit all board sizes including short boards, long boards, fishes, eggs, body boards, kite boards, Stand up paddle boards and paddles. The surfboard sling is also capable of carrying firewood, food coolers, beach chairs, oversized gear or other hard to haul items.

The multi-purpose mat transforms into shade shelter that provides protection from both sun and rain. The plurality of tent poles are attached together and inserted into one end of each of the pair of pole pockets on the outer surface of the mat and taken out at the other end of each of the pair of pole pockets. The shade shelter is erected by pushing the plurality of tent poles up and together. The ends of the plurality of tent poles are inserted and pushed down into the sand for stability. The plurality of wing pockets of the mat allows for easy adjustment to any sun angle. The plurality of wing pockets also serve as tent pole stabilizers by allowing to have weight to the inside of the plurality of wing pockets which will help in stabilizing the shade shelter when it is in position.

The multi-purpose mat is made of opaque materials which virtually eliminates ultra-violet radiation. The waterproof material of the multi-purpose mat allows for use in rain. The plurality of tent poles deliver quick set-up of the shade shelter and provides more stability than traditional beach umbrellas in windy conditions. The pair of grommets at opposing ends of each of the pair of webbing straps allows the multi-purpose mat to be set up in different configurations of shelter. The multi-purpose mat can be tied onto trees, truck beds, picnic tables, bicycles and more when shelter is needed.

The present embodiment provides a multi-purpose mat that can be converted into a beach mat, a backpack bag, a surfboard carrier sling and a shade shelter. The multi-purpose mat is circular in shape and is easily configured to achieve the different forms. The multi-purpose mat comprises a cushy waterproof foam surface that does not collect sand, dries quickly, and provides more surface area than a traditional beach towel. The mat also comprises multiple pockets that provide a discreet way to stash sunglasses, wallet, cell phone etc. The multi-purpose mat can be configured as a backpack bag, messenger bag or quick carry bag. Further, the mat is able to carry heavy gear such as surfboards, beach chairs, food coolers, and firewood. Such a unique multi-purpose mat provides a stable shelter that offers protection from both sun and rain. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

The following describes example embodiments in which the present invention may be practiced. This invention, however, may be embodied in many different ways, and the description provided herein should not be construed as limiting in any way. Among other things, the following invention may be embodied as methods or devices. As such, the present invention may take the form of an entirely hardware embodiment, an entirely software embodiment, or an embodiment combining software and hardware aspects. The following detailed descriptions should not be taken in a limiting sense.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Figure 1A:
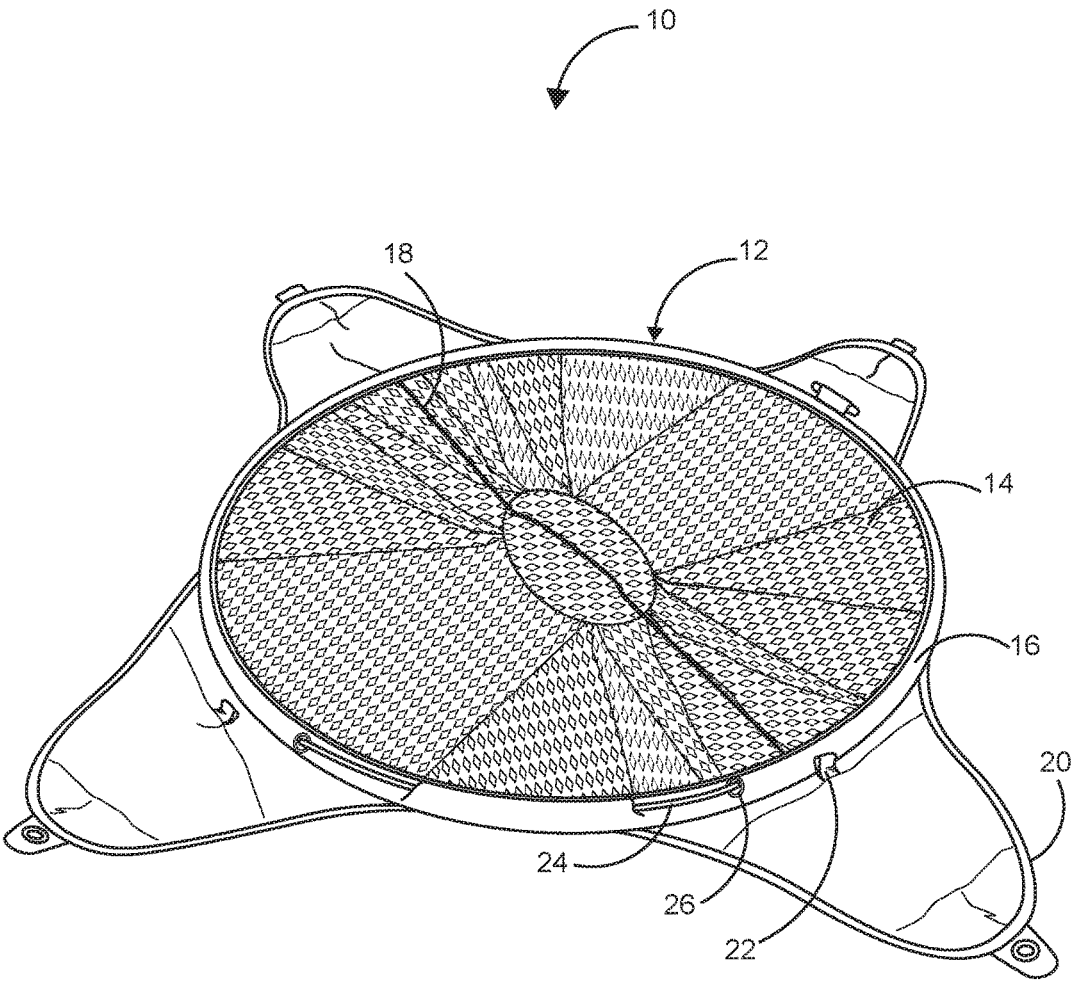
FIGS. 1A-1B illustrate perspective views of a multi-purpose mat in accordance with a preferred embodiment of the present invention.
Figure 1B:
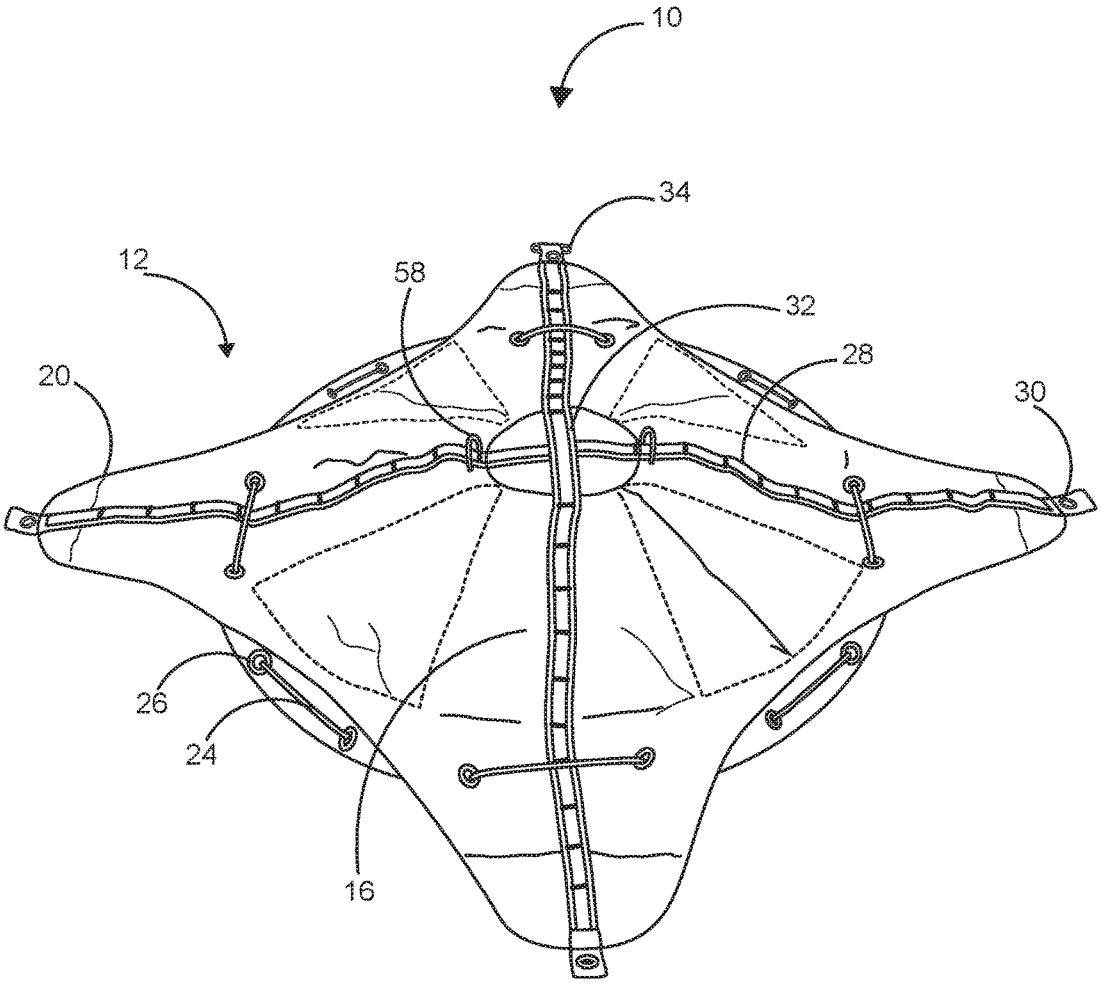

Referring to FIGS. 1A-1B, perspective views of a multi-purpose mat 10 in accordance with a preferred embodiment of the present invention are illustrated. FIG. 1A is a top perspective view of the multi-purpose mat 10. The multi-purpose mat 10 comprises a circular flat body portion 12 having an inner surface 14 and an outer surface 16. The inner surface 14 comprises a structural fold pattern 18. A plurality of wing pockets 20 extends from a peripheral edge of the outer surface 16 and spaced at ninety degree intervals from each other. A plurality of interior pockets 22 is located between the inner surface 14 and the outer surface 16 and adjacent to the plurality of wing pockets 20. A drawstring 24 is interwoven through a plurality of eyelets 26 along the perimeter of the outer surface 16.

Figure 2:
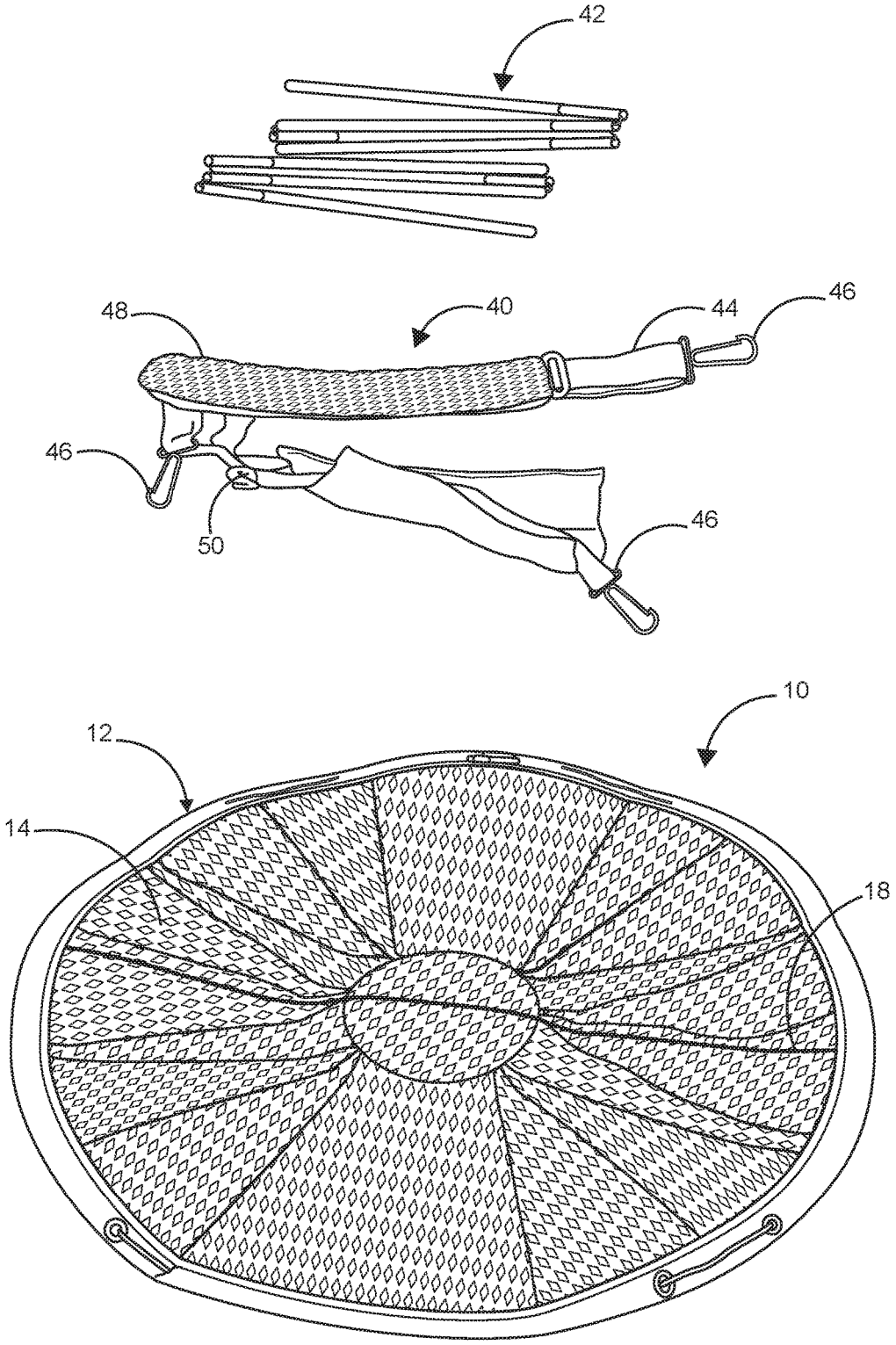
FIG. 2 is a perspective view of the multi-purpose mat of the present invention illustrating a functional strap and a plurality of tent poles.

Turning to FIG. 1B, a bottom perspective view of the multi-purpose mat 10 is shown. A pair of webbing straps 28 is attached to the outer surface 16 of the multi-purpose mat 10 and positioned at right angles to each other. Each of the pair of webbing straps 28 extends between at least two of the plurality of wing pockets 20 on opposite edges of the outer surface 16 and has a pair of grommets or clips 30 at opposing ends. A pair of pole pockets 32 is attached to the outer surface 16 and below the pair of webbing straps 28. At least one of the plurality of wing pockets 20 includes a bag clip 34, a bag handle 36 (FIG. 4A) and a pair of clip receivers 38 (FIG. 4B) on both sides of the bag handle. The invention also includes a functional strap 40 (FIG. 2) and a plurality of tent poles 42 (FIG. 2). The outer surface 16 of the mat 10 also comprises a par of clip receivers 58 towards the center to receive the functional strap 40. The multi-purpose mat 10 provides a beach mat 60 (FIG. 3) that may be configured for use as a backpack bag 70 (FIGS. 4A-4C) and a surfboard sling 80 (FIG. 5) utilizing the functional strap 40 (FIG. 2) and as a shade shelter 90 (FIGS. 6A-6B) by way of using the plurality of tent poles 42 (FIG. 2).

Figure 4A:
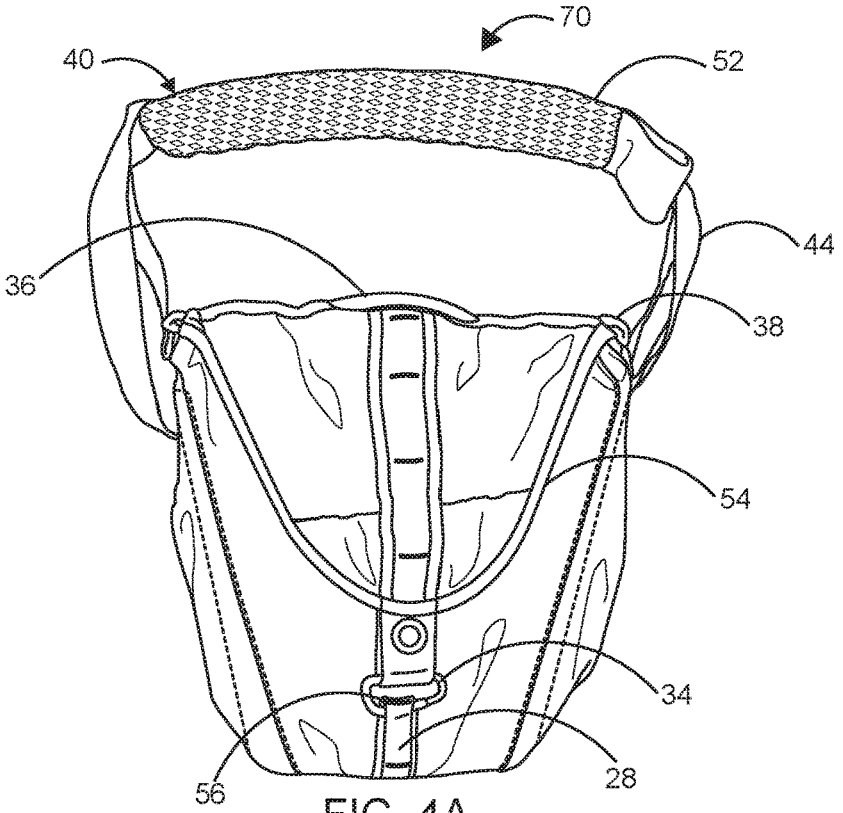
FIGS. 4A-4C illustrate perspective views of the present invention, illustrating the multi-purpose mat in use as a backpack bag.
Figure 4B:
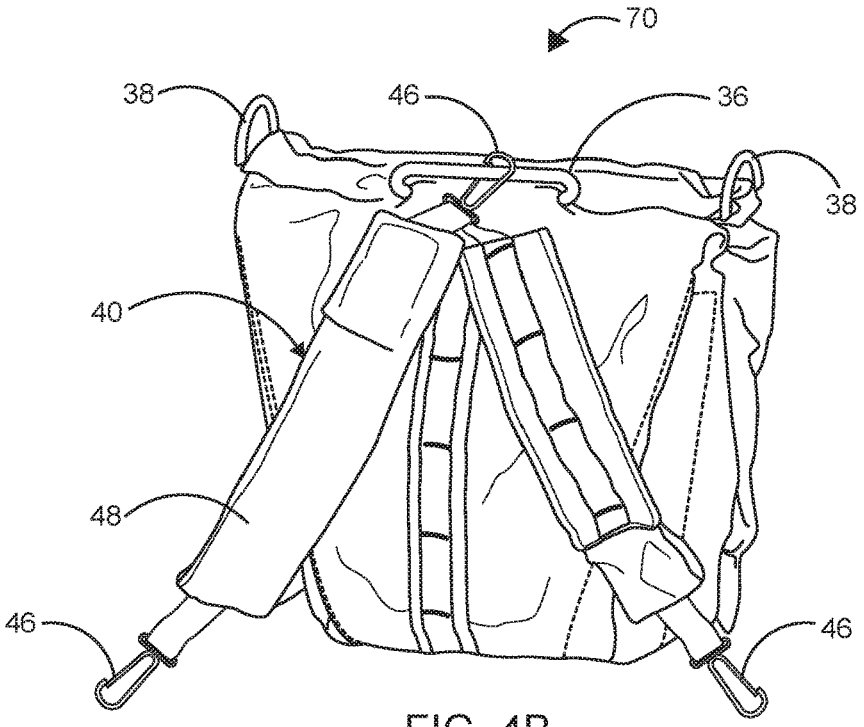
Figure 4C:
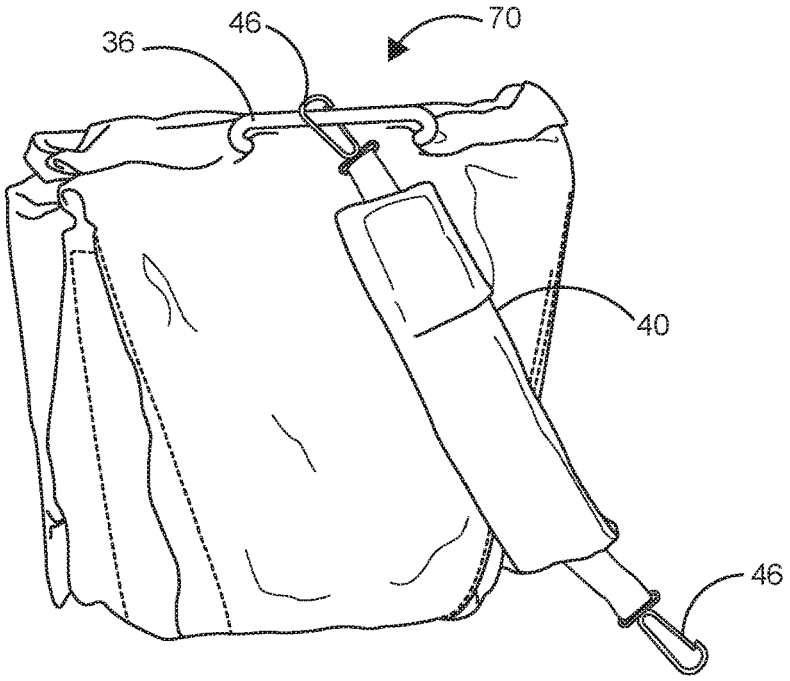
Figure 5:
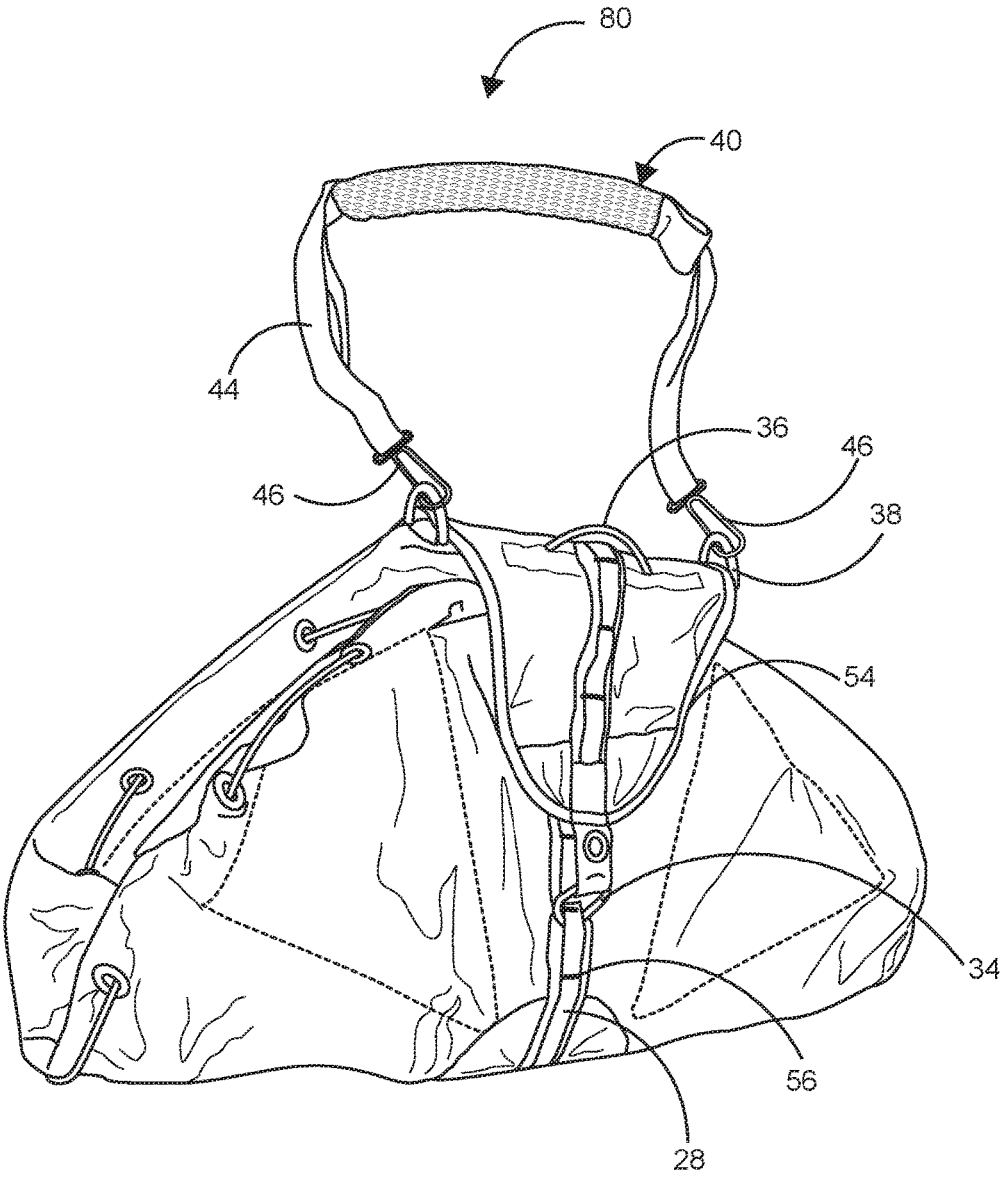
FIG. 5 is a perspective view of the present invention, illustrating the multi-purpose mat in use as a surfboard sling.

FIG. 2 is a perspective view of the multi-purpose mat 10 of the present invention illustrating a functional strap 40 and a plurality of tent poles 42. The inner surface 14 of the multi-purpose mat 10 comprises the structural fold pattern 18 which allows the multi-purpose mat 10 to be folded into a backpack bag 70 (FIGS. 4A-4C). The fold pattern 18 includes a linear pattern radiating from a circle at the center of the inner surface 14 and is similar to an umbrella pattern. By strategically folding the mat 10 along the lines of the structural fold pattern 18, the mat 10 may be converted into the backpack bag 70 (FIGS. 4A-4C). The plurality of wing pockets 20 may be folded into the plurality of interior pockets 22 as shown in figure, when the mat 10 is converted into the backpack bag 70 (FIGS. 4A-4C) or surfboard carrier sling 80 (FIG. 5).

The functional strap 40 comprises an adjustable strap 44 with a plurality of clips 46 and a pair of shoulder pads 48 closed over the adjustable strap 44. Each of the pair of shoulder pads 48 are joined together at one end with a slit 50 in between. The adjustable strap 44 is inserted through the slit 50. The functional strap 40 may be converted into a backpack harness, a messenger bag harness or a carry handle and can be attached quickly. The adjustable strap 44 can be adjusted in length to suit the height of a user. When used as a backpack harness, each pair of shoulder pads 48 is closed over the adjustable strap 44 by means of Velco such that, two of the plurality of clips 46 comes at the opposing ends of the functional strap and one of plurality of clips 46 comes in between the pair of shoulder pads 48. When used as a messenger bag harness or a quick carry handle, a first one of the pair of shoulder pads 48 is removed from the adjustable strap 44 and closed over a second one of the pair of shoulder pads 48 to form a single pad 52 (FIG. 4D) around the adjustable strap 44. The plurality of tent poles 42 may be ordinary fiberglass or metal tent poles that have several stages which clip together and used in common everyday tents.

Figure 3:
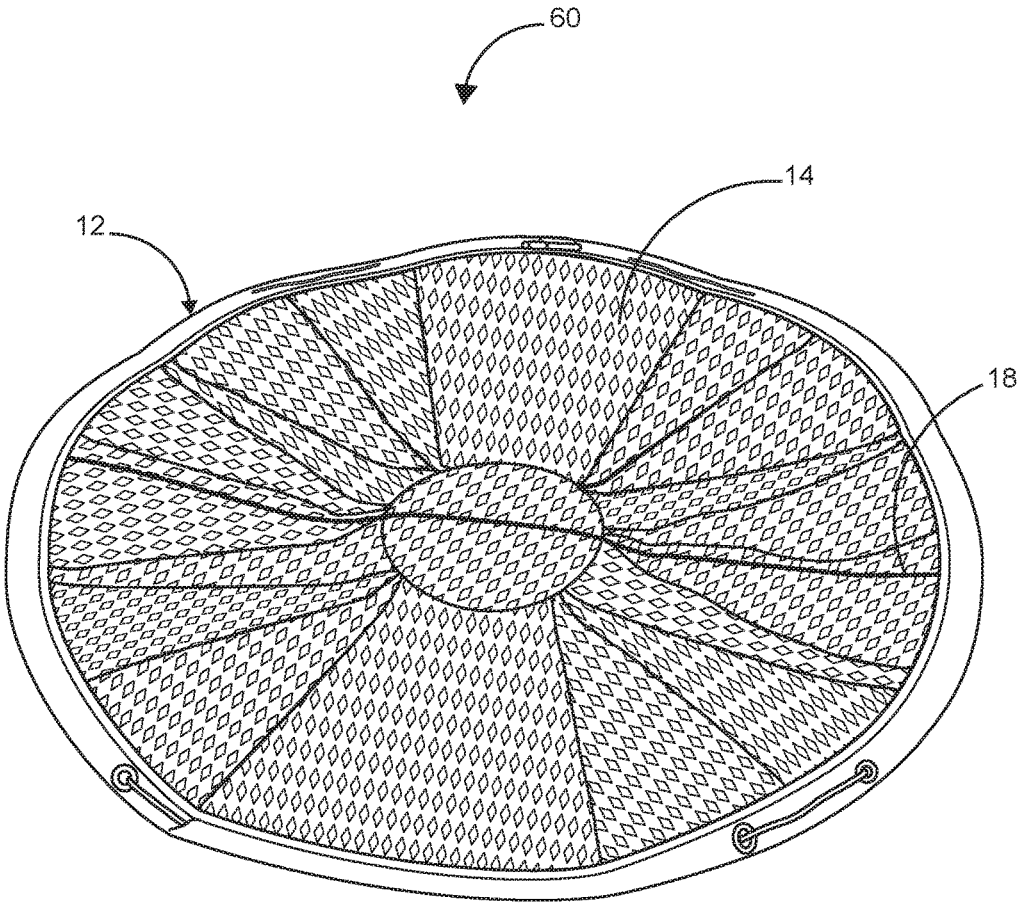
FIG. 3 is a perspective view of the present invention, illustrating the multi-purpose mat in use as a beach mat.

FIG. 3 is a perspective view of the present invention, illustrating the multi-purpose mat 10 in use as a beach mat 60. The inner surface 14 of the mat 10 is made of molded diamond EVA (Ethylene Vinyl Acetate) film cushion or the like which is waterproof. The waterproof EVA film cushion provides padding, does not collect sand and dries quickly. The plurality of wing pockets 20 extending from the outer surface 16 and the plurality of interior pockets 22 between the inner surface 14 and the outer surface 16 provide multiple pockets for storing accessories that may be chosen from a group including but not limited to: sunglasses, wallet, cell phone, surf wax and wet suit.

The beach mat 60 offers more surface area than a traditional beach towel for sitting or sunbathing and makes changing into a wetsuit on a rocky beach, dirt trail, or asphalt parking lot clean and comfortable. The beach mat 60 allows packing away a soggy wetsuit in order to keep the car dry after a surf session. Further, the beach mat 60 can be cleaned easily by hosing off and hanging to dry.

FIGS. 4A-4C illustrate perspective views of the present invention, illustrating the multi-purpose mat 10 in use as a backpack bag 70. The plurality of wing pockets 20 is folded into the plurality of interior pockets 22, except the at least one of the plurality of wing pockets 20 with the bag clip 34 and the bag handle 36, which acts as a flap 54 for closing the bag 70. The multi-purpose mat 10 is strategically folded along the structural fold pattern 18 into the shape of the backpack bag 70 and the drawstring 24 is drawn tight and tied with a cord lock to keep the backpack bag 70 from unfolding. The pair of webbing straps 28 provides a plurality of attachment points 56 for the bag clip 34 and the functional strap 40. The wing pocket flap 54 is closed over the top of the bag 70 and the bag clip 34 is secured on at least one of the plurality of attachment points 56 of the pair of webbing straps 28.

The backpack bag 70 (as shown in FIG. 4B) can be converted into a messenger bag (as shown in FIG. 4A) or a quick carry bag (as shown in FIG. 4C) by simply changing the attachment points of the functional strap 40 on the backpack bag 70. FIG. 4A illustrates a front perspective view of the multi-purpose mat 10 in use as a backpack bag 70 with a messenger bag harness. The pair of shoulder pads 48 of the functional strap 40 is closed one over the other to form a single pad 52 around the adjustable strap 44. Two of the plurality of clips 46 on opposing ends of the adjustable strap 44 is attached to the pair of clip receivers, 38 on both sides of the bag handle 36 on top of the bag 70. Now the functional strap 40 can be used as a messenger bag harness.

Turning to FIG. 4C, a back perspective view of the multi-purpose mat 10 in use as a backpack bag 70 with a quick carry handle is illustrated. One of the plurality of clips 46 of the functional strap 40 may be attached to the bag handle 36 on top of the bag 70 and another one of the plurality of clips 46 is attached to one of the pair of clip receivers 58 (FIG. 1B) near the bottom of the bag 70. Now the functional strap 40 can be used as a carry handle.

Referring to FIG. 4B, a back perspective view of the multi-purpose mat 10 in use as a backpack bag 70 with a backpack harness is illustrated. The adjustable strap 44 is inserted through the slit 50 in between the pair of shoulder pads 48 and each of the pair of shoulder pads 48 are closed over the adjustable strap 44. One of the plurality of clips 46 of the functional strap 40, between the pair of shoulder pads 48 is attached to the bag handle 36 on top of the bag 70 so that at least one of the pair of shoulder pads 48 comes on each side of the bag handle 36. Two of the plurality of clips 46 on opposing ends of the adjustable strap 44 is attached to the pair of clip receivers 58 (FIG. 1B) near the bottom of the bag 70 at the two sides. Now the functional strap 40 can be used as a backpack harness. The backpack bag 70 of the present invention is capable of expanding to accommodate larger items that do not normally fit in a traditional backpack. The backpack bag 70 provides a flexible method for transporting gear to the beach including wetsuit, hats, sandals, swim fins, drink bottles, radios, etc.

Figure 4D:
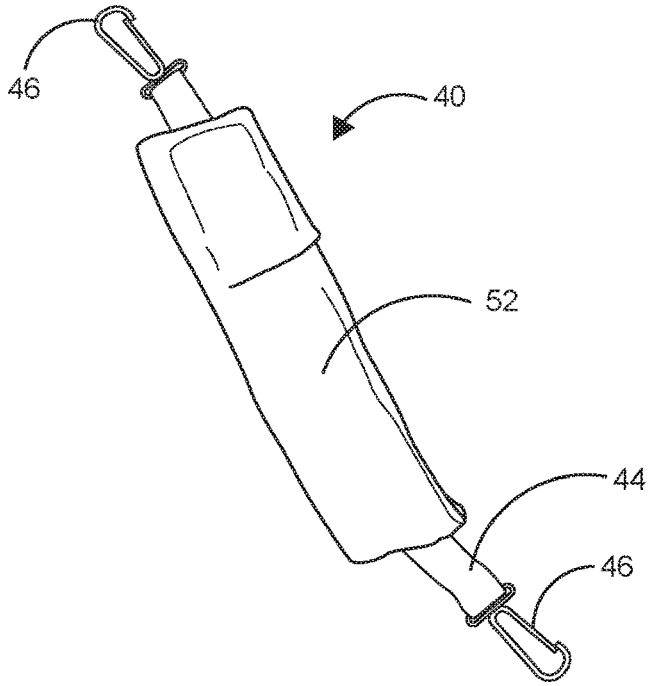
FIG. 4D is a perspective view of the present invention, illustrating the functional strap.

FIG. 4D is a perspective view of the present invention, illustrating the functional strap 40. The pair of shoulder pads 48 of the functional strap 40 is closed one over the other to form a single pad 52 around the adjustable strap 44. One of the plurality of clips 46 is enclosed within the single pad 52. Those configuration of the functional strap 40 can be used as the messenger bag harness or the carry handle.

FIG. 5 is a perspective view of the present invention, illustrating the multi-purpose mat 10 in use as a surfboard carrier sling 80. The plurality of wing pockets 20 is folded into the plurality of interior pockets 22, except the at least one of the plurality of wing pockets 20 with the bag clip 34 and the bag handle 36, which acts as the flap 54 for closing the sling 80. The multi-purpose mat 10 is folded in half along one of the pair of webbing straps 28 and a surfboard (not shown) is inserted in between the two halves of the mat 10. The mat 10 folds over the surfboard (not shown) and the wing pocket flap 54 is closed on top of the sling 80 by attaching the bag clip 34 to one of plurality of attachment points 56 on the pair of webbing straps 28, isolating the surf board (not shown) in the sling 80. The pair of shoulder pads 48 of the functional strap 40 is closed one over the other to form the single pad 52 around the adjustable strap 44. Two of the plurality of clips 46 on opposing ends of the adjustable strap 44 is attached to the pair of clip receivers 38 on both sides of the bag handle 36.

The surfboard sling 80 provides a versatile way to carry surfboards. The functional strap 40 provides a comfortable shoulder strap which makes it easy to carry the surfboard to the beach, while the EVA film cushion of the inner surface 14 of the mat 10 protects the surfboard (not shown) from dings while in transit. The surfboard carrier sling 80 has an open ended design that adapts to fit all board sizes including short boards, long boards, fishes, eggs, body boards, kite boards, stand up paddle boards and paddles. The surfboard sling 80 is also capable of carrying firewood, food coolers, beach chairs, oversized gear or other hard to haul items.

Figure 6A:
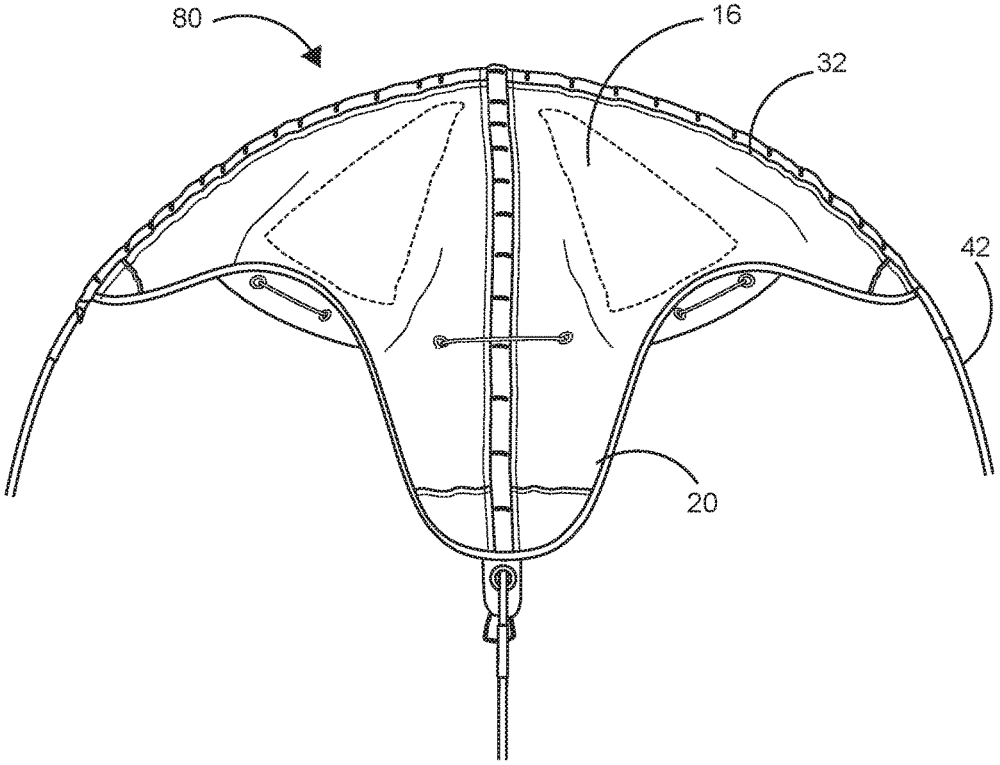
FIGS. 6A-6B illustrate perspective views of the present invention, illustrating the multi-purpose mat in use as a shade shelter.
Figure 6B:
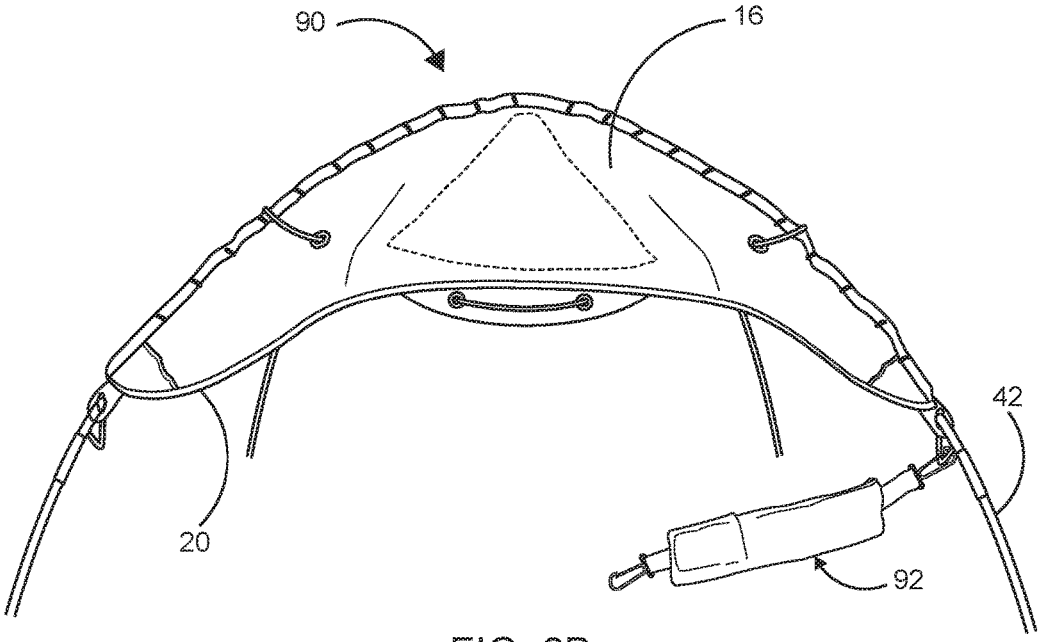

FIGS. 6A-6B illustrate perspective views of the present invention, illustrating the multi-purpose mat 10 in use as a shade shelter 90. The multi-purpose mat 10 is laid flat on the ground with the outer surface 16 facing upwards. The plurality of tent poles 42 of the invention are capable of attaching to each other. The plurality of tent poles 42 that are attached together are inserted into one end of each of the pair of pole pockets 32 on the outer surface 16 of the mat 10 and taken out at the other end of each of the pair of pole pockets 32. The shade shelter 90 is erected by pushing the plurality of tent poles 42 up and together. The ends of the plurality of tent poles 42 are inserted and pushed down into the sand or ground for stability. The plurality of wing pockets 20 of the mat 10 allows for easy adjustment to any sun angle. The plurality of wing pockets 20 also serve as tent pole stabilizers by allowing to have weight to the inside of the plurality of wing pockets 20 which will help in stabilizing the shade shelter 90 when it is in position. Also, a pole tensioner strap 92 provides extra stability.

The shade shelter 90 provides shelter from both sun and rain. The multi-purpose mat 10 is made of opaque materials which virtually eliminates harmful ultra-violet radiation. The waterproof material of the multi-purpose mat 10 allows for use in rain. The plurality of tent poles 42 deliver quick set-up of the shade shelter 90 and provides more stability than traditional beach umbrellas in windy conditions. The pair of clips or grommets 30 at opposing ends of each of the pair of webbing straps 28 allows the multi-purpose mat 10 to be set up in different configurations of shelter. The multi-purpose mat 10 can be tied onto trees, truck beds, picnic tables, bicycles and more when shelter is needed.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A mat comprising:

a flat body portion having an inner surface and an outer surface;

a plurality of outer pockets extending outward from a peripheral edge of the outer surface;

a pair of straps attached to the outer surface with, each of the pair of straps extending between at least two of the plurality of outer pockets located on opposing edges of the outer surface; and a drawstring coming into contact with a plurality of eyelets along a perimeter of the outer surface.

2. The mat of claim 1 wherein the body portion may be folded in half to form a sling.

3. The mat of claim 2 wherein a functional strap is attached to the sling.

4. The mat of claim 1 wherein a plurality of poles are inserted through a pair of pole pockets and pushed up and together to erect the body portion to form a shelter.

5. The mat of claim 1 wherein a pair of grommets at opposing ends of each strap allows the body portion to be set up in different configurations of shelter.

6. The mat of claim 1 wherein the inner surface is made of a waterproof substance such as molded EVA (Ethylene Vinyl Acetate) film cushion.

7. The mat of claim 1 wherein the plurality of wing pockets and the plurality of interior pockets provide a means for storing accessories that may be chosen from a group including but not limited to: sunglasses, wallet, cell phone, surf wax and wet suit.

8. The mat of claim 1 further comprising a plurality of interior pockets between the outer surface and the inner surface and adjacent to the plurality of outer pockets.

9. A mat comprising:

a body portion having an inner surface and an outer surface;

a plurality of outer pockets extending outward from a peripheral edge of the outer surface;

a pair of straps attached to the outer surface with each of the pair of straps extending between at least two of the plurality of outer pockets located on opposing edges of the outer surface;

whereby the mat provides a beach mat that may be configured for use as a backpack bag or a sling utilizing a functional strap and as a shelter by way of using a plurality of poles.

10. The mat of claim 9 wherein the body portion may be folded to form the backpack bad.

11. The mat of claim 9 wherein the body portion may be folded in half along one of the pair of straps to form the sling, and be secured by means of a clip and the pair of straps, and be carried by means of the functional strap.

12. The mat of claim 9 wherein the body portion may be erected to form the shelter by inserting the plurality of poles through a pair of pole pockets.

13. The mat of claim 9 further comprising a plurality of interior pockets between the outer surface and the inner surface and adjacent to the plurality of outer pockets.

14. A mat comprising:

a circular flat body portion having an inner surface and an outer surface, the inner surface further comprising a structural fold pattern that allows the body portion to be folded into a bag and a carrier sling;

a plurality of outer pockets extending outward from an edge of the outer surface, at least one of the plurality of pockets further comprising a clip and a handle and a pair of clip receivers on both sides of the handle;

a pair of grommets at opposing ends of each of a pair of straps;

a functional strap having an adjustable strap having a plurality of clips, and a pair of shoulder pads inserted over the adjustable strap;

whereby the mat provides a beach mat that may be configured for use as the bag or the carrier sling utilizing the functional strap and as a shelter by way of using a plurality of poles.

15. The mat of claim 14 wherein the beach mat is padded and waterproof and the plurality of outer pockets provide for storing accessories that may be chosen from a group including but not limited to: sunglasses, wallet, cell phone, surf wax and wet suit.

16. The mat of claim 14 wherein the bag may be converted into a messenger bag or a quick carry bag by adjusting the functional strap.

17. The mat of claim 14 wherein the carrier sling can carry items that may be chosen from a group including but not limited to: surfboards, firewood, food coolers, beach chairs and oversized gear.

18. The mat of claim 14 further comprising a plurality of interior pockets between the outer surface and the inner surface and adjacent to the plurality of outer pockets.

* * * * *